United States Patent [19]

Ehrenfried

[11] Patent Number: 4,653,582

[45] Date of Patent: Mar. 31, 1987

[54] POINT INDICATING SYSTEM FOR COMBAT SPORTS

[75] Inventor: Ted R. Ehrenfried, Newport News, Va.

[73] Assignee: Treco Products, Inc., Newport News, Va.

[21] Appl. No.: 736,703

[22] Filed: May 22, 1985

[51] Int. Cl.[4] ..... A41D 13/10

[52] U.S. Cl. ..... 116/222; 116/203; 272/76; 273/346; 273/DIG. 30; 2/16; 2/161 A

[58] Field of Search ..... 116/203, 205, 222, 225, 116/84; 273/1 F, 1 R, 346, 347, 416–419, DIG. 26, DIG. 30; 2/16, 18, DIG. 6, 161 A; 272/76, 98; 428/100; 446/901, 100, 327

[56] References Cited

U.S. PATENT DOCUMENTS

| | | | |
|---|---|---|---|
| 2,729,024 | 1/1956 | Guttmann | 46/154 |
| 2,803,087 | 8/1957 | Zalkind | 272/98 |
| 2,998,974 | 9/1961 | Stafford | 272/98 |
| 3,063,718 | 11/1962 | Steinkamp | 273/55 |
| 3,147,011 | 9/1964 | Lemelson | 273/106.5 |
| 3,484,974 | 12/1969 | Culmone | 40/129 |
| 3,829,094 | 8/1974 | Goldfarb et al. | 273/95 |
| 3,866,909 | 2/1975 | DeSantis | 272/76 |
| 3,913,183 | 10/1975 | Brumlik | 428/100 |
| 3,953,030 | 4/1975 | Muchnick | 273/95 |
| 3,967,823 | 6/1975 | Yount | 273/95 |
| 3,997,162 | 12/1976 | Scullin | 273/95 |
| 3,999,748 | 12/1976 | Clarke | 273/95 |
| 4,012,544 | 3/1977 | Richards | 428/100 |
| 4,055,343 | 10/1977 | Stuart | 273/346 |
| 4,249,268 | 2/1981 | Berler | 2/115 |
| 4,361,912 | 12/1982 | Arthur | 2/18 |
| 4,432,545 | 2/1984 | Vanderpool | 273/1 |

FOREIGN PATENT DOCUMENTS

| | | | |
|---|---|---|---|
| 197803 | 3/1978 | U.S.S.R. | 272/76 |

*Primary Examiner*—Charles Frankfort
*Assistant Examiner*—Patrick R. Scanlon
*Attorney, Agent, or Firm*—Stevens, Davis, Miller & Mosher

[57] ABSTRACT

An indicator which is carried by a participant capable of delivering an offensive blow in a combat sport. The indicator in a preferred embodiment utilizes a hook and loop fastener to maintain its position on the glove or foot of the participant until contact has been made with an opponent. The opponent has a portion of a hook and pile fastening system located on his person which is compatible with the external portion of the indicator when mounted on the participant's equipment. When a blow is struck, a greater amount of retaining force is developed between the indicator and the opponent's hook and loop fastening system then is present between the indicator and the participant's hook and loop fastening system, causing the indicator to be transferred to the opponent at the point of contact. In one embodiment, a small streamer can be attached to the indicator and sandwiched between the indicator substrate and the participant's equipment. However, when the indicator is transferred to the opponent during a blow, the streamer is pulled free and serves as a further visual indication of the existence and position of contact between the participant and his opponent.

4 Claims, 7 Drawing Figures

POINT INDICATING SYSTEM FOR COMBAT SPORTS

BACKGROUND OF THE INVENTION

1. Field of the Invention

The present invention is related to sports and sporting goods and is specifically related to an indication of a contact point between two participants or between one participant and a target in combat sports practice.

2. Discussion of the Prior Art

In many combat sports such as boxing, savat (French foot fighting), karate, etc. points are awarded based upon the number of contacts made between opponents as well as the position of the contact. In boxing, for example, the position and exact contact point of a blow to the head or body is not important and it is the number of contacts occurring per round which will determine who is awarded how many points for that round. However, in karate and in particular amateur point karate, it is the actual point of contact which determines the winner or loser of a match. Generally, three to four judges position themselves around two participants and when all or a majority of the judges agree as to contact and location of the contact, the point is awarded to the appropriate party.

Because of the speed of hand (foot) movement involved and the protective gear worn by the participants, one can appreciate that it is extremely difficult to visually observe whether actual contact was made and the precise location of any such contact. The participants are trained to deliver non-lethal and non-disabling blows in order to protect their opponents against serious injury. However, it also behooves a contestant to deliver a hard enough blow that the judges can clearly appreciate that contact was made in the desired location. Accordingly, it benefits participants to perhaps be overaggressive and to err on the side of too much contact rather than too little contact. This results in inadvertent injuries to participants of the sport.

The necessity for having four judges positioned around the participants means that an extraordinary number of people are necessary for point karate tournaments and matches. While it would be possible to video tape each match, at least two separate camera angles would be required to ensure complete coverage, requiring at least two cameramen and a judge to review the video tapes and determine at which point a blow was delivered which is sufficient to award a score to the individual. This would be less personnel intensive but would be extremely expensive especially for large tournaments.

Additionally, point karate rules presently permit scoring of more than one point with the same type of punch, i.e., a karate "chop", toe kick, etc. Therefore, an individual who is expert at only one punch can score enough repetitive points to win ove his opponent. A rules change is anticipated which will allow only one point to be awarded for each different type of punch. This would be exceedingly difficult to judge visually and to be remembered during even a two minute match.

U.S. Pat. No. 2,729,024 to Guttmann teaches the use of an ink reservoir in the end of a boxing glove of an animated toy puppet in order to provide a record in terms of visible ink of where one toy puppet has "hit" the other toy puppet. As can be imagined, the application of this concept to actual combat sport participants would result in ink stains all over the various contestants and the officials not knowing whether the ink smudge was indeed caused by an opponent or by the participants own glove. After several rounds in a tournament, a participant might be covered with ink smudges making it exceedingly difficult to determine whether a particular smudge is from a recent contact or an old contact.

Soviet Union Patent No. 598,613 teaches the utilization of impact transducers in a boxers clothing which upon being impacted by an opponent's glove provide an electronic pulse to a recording mechanism which indicates the existence of a contact and its location. Since the place and number of impacts can be recorded, the winner of a boxing match can be determined. However, such a system is expensive and would require either a wireless transmission system or each boxer to wear the recording device for later playback to determine who won the particular round. For several hundred participants in a point karate tournament to wear such devices would require an enormous expenditure of funds for the equipment initially and for the read-out of the equipment after each match. Furthermore, the emphasis is still upon making a sufficiently hard contact to close the contacts in the transducer and of course the system does not take into account the possibility of wireless or transducer failures which may occur in the rugged impact environment, especially with electrical/mechanical devices.

SUMMARY OF THE INVENTION

Accordingly, it is an object of the present invention to provide a contact point indicating system which is inexpensive, easy to use, and is highly reusable.

It is a further object of the present invention to provide a contact point indicating system in which the slightest contact by a participant upon his opponent is clearly indicated by a marker of the contact position.

It is a further object of the present invention to provide a training system for combat sport participants in which the exact position of impact of a participant's body on a target is indicated in order that he may determine his own score and accuracy during training.

It is a still further object of the present invention to provide a contact point indicating system which is unaffected by the impact of the contact between participants and indeed tends to advantage, if at all, the lesser force contact.

The above and other objects are achieved in accordance with an apparatus embodiment of the present invention for a participant and his opponent by the use of a contact point indicating system comprising: at least one indicator means; inferior means, associated with said at least one participant, for removably mounting said indicator means; and superior means, associated with at least one opponent for retainably mounting said indicator means, said superior means comprising a means in combination with said indicator means for generating a greater retaining force and said inferior means in combination with said indicator means comprising a means generating a lesser retaining force, whereby said indicator means remains in contact with said inferior means until contact is made with said superior means, wherein said greater retaining force causes said indicator means to transfer to and remain in position with respect to said superior means and said opponent.

The above and other objects are achieved in accordance with a method embodiment of the present invention wherein there are included the steps of: providing at least one indicator means; providing at least one participant with an inferior means for removably mounting said indicator means; and providing at least one opponent with a superior means for retainably mounting said indicator means where said superior means in combination with said indicator means comprising means generating a greater retaining force and said inferior means in combination with said indicator means comprising means generating a lesser retaining force, whereby said indicator means remains in contact with said at least one participant and said inferior means until contact is made with said at least one opponent upon which said superior means is mounted, whereupon said greater retaining force causes said indicator means to transfer to and remain in position on said superior means and said opponent.

BRIEF DESCRIPTION OF THE DRAWINGS

The above and other objects will become more apparent from the following description and accompanying drawings, wherein.

DETAILED DESCRIPTION OF THE PREFERRED EMBODIMENTS

Figure 2:
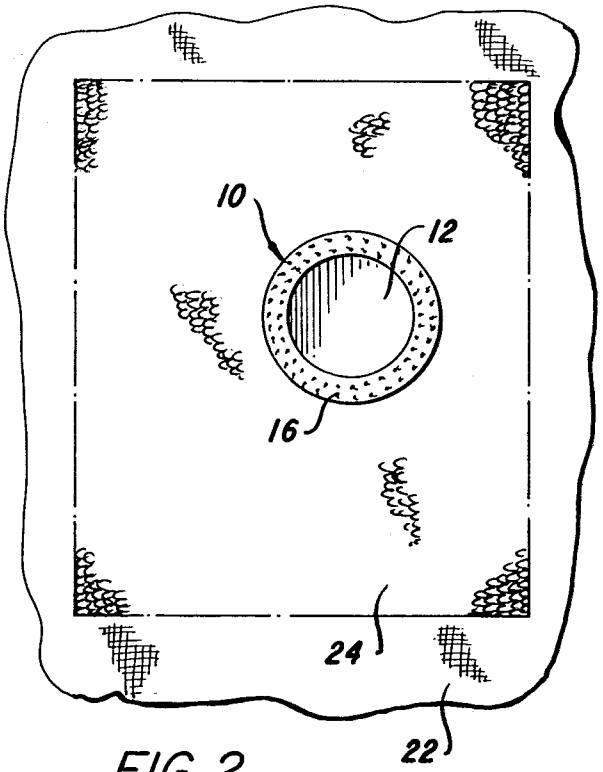
FIG. 2 is a view of FIG. 1 along section lines II—II.
Figure 1:
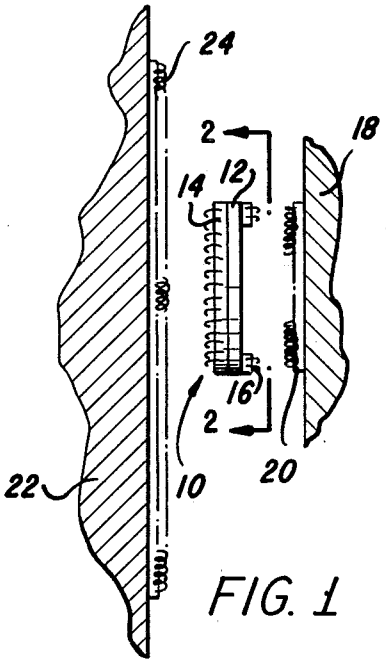
FIG. 1 is a side-view partially in section illustrating the three components of the present invention.

Referring now to the drawings in which like reference numerals indicate similar elements in respective views, FIG. 1 illustrates elements of the indicator system. For simplicity sake, the individuals delivering a blow will be referred to as the participant and the individual receiving the blow will be referred to as the opponent. It should be noted that the opponent can be a target system or a life-like model of an opponent for practice purposes. It is envisioned that during an actual point karate match, both individual contestants will have the participant and opponent components of the system and thus blows delivered by both individuals will be recorded on the other.

With the above convention in mind, FIG. 1 generally illustrates an indicator means at 10 including a substrate 12 having two sides, each of which are attached to one part of a two-part hook and loop fastener system, for example Velcro. It is understood that while the hook and loop materials are shown in a particular configuration, it is unnecessary for them to be organized as indicated and it is only necessary that the indicator material be the opposite to that of the surface that the indicator is in contact with.

As shown, one side of substrate 12 is completely covered with hook-type material 14 and the other side is only partially covered with a ring of hook-type material 16. The participant and opponent would both be wearing karate protective equipment including gloves, boots, shinguards, chest protectors and head gear as is generally done when practicing the sport. The participant's equipment 18 such as a glove or foot protective item, includes a small area of loop-type material 20. The opponent on his protective equipment (or clothing) 22 has a similar loop-type material 24. As noted above, it is only necessary that the opposing surfaces, i.e. participant/indicator or indicator/opponent be covered with attachable hook/loop-type material. It is not necessary in fact that the same type material be used on both sides of the indicator. Thus, the loop-type material 20 and the hook-type material ring 16 could be reversed, just as could be the hook-type material 14 and the loop-type material 24. The only critical arrangement is that the force to seperate the hook/loop interengagement is greater between the indicator and the opponent than the separation force between the indicator and the participant. The reason for this will become apparent by reference to FIGS. 3A–3C.

Figure 3A:
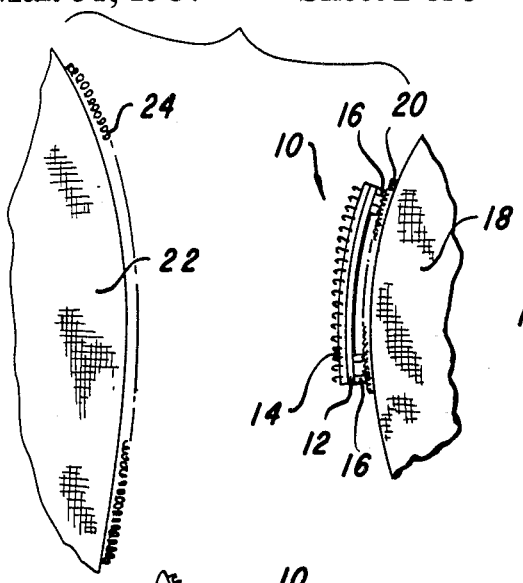
FIGS. 3A, 3B and 3C are side-views illustrating the transfer of the position indicator from one participant to another participant.
Figure 3B:
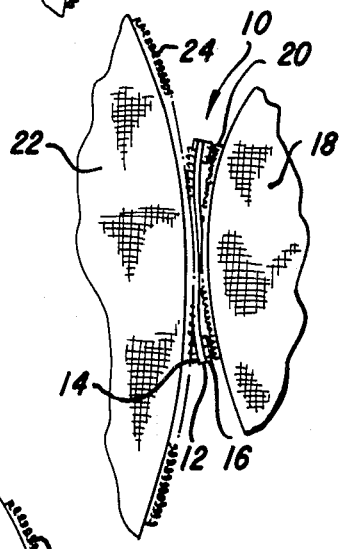
Figure 3C:
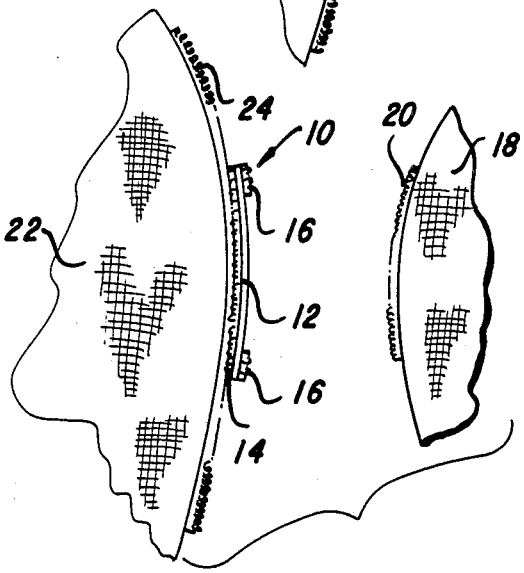

Referring now to FIGS. 3A–3C, the individual hooks and loops have not been illustrated for clarity of understanding. FIG. 3A illustrates the indicator means 10 mounted on fastener material 20 which is in turn mounted on the participant's offensive protective equipment 18 (i.e. glove or boot). The interaction between hook-type material 16 of the indicator and loop-type material 20 on participant's equipment 18 comprises an inferior means for removably mounting the indicator means on the participant's equipment 18.

FIG. 3B illustrates the participant striking a blow on his opponent. Although the indicator 10 is maintained in position on participant's equipment 18 by virtue of the inferior removable mounting means, the hook-type material 14 of the indicator means 10 is now in contact with loop-type material 24 on the opponents equipment 22. The hook-type material 14 and the loop-type material 24 comprise a superior means for retainably mounting the indicator means on the opponent's equipment 22. It will be appreciated that the area of hook/loop interengagement is much greater between the indicator and the opponent as opposed to the area of interengagement between the indicator and the participant, thus providing the necessary difference in separation forces.

FIG. 3C illustrates the withdrawal of the participant's protective equipment 18 after the blow has been delivered. Because of the greater area of contact and the greater retaining force developed by the superior means, as opposed to the inferior means, the indicator "sticks" to the loop-type material 24 of opponent's equipment 22 providing a precise indication that a "hit" has occurred and giving a specific indication of the exact contact point. Thus, the indicator is successfully and positively transferred from the participant's equipment to that of his opponent upon completion of the blow.

With respect to the participant's protective equipment, and because a point can be scored by virtue of a number of different locations, Velcro material analogous to loop-type material 20 could be located at many different places, each place having an indicator mounted thereon at the begining of the match. Such places could include the back of a glove for transferring during a backhand strike; the area of the thumb-hand junction; the area of the little finger for the traditional karate "chop", and the area of the outer portion of the fingers corresponding to the traditional "boxing" point of contact. In the footgear, loop-type material 20 could be located at the toe, the heel and the inside and outside portions of the foot. Thus, the loop-type material 20 is mounted on said participant, i.e. directly on clothing or in similar close proximity to the participant's body.

With respect to the opponent's equipment, of course it is possible to locate loop-type material 24 over the complete area of clothing of the opponent. However, since points are awarded for blows delivered and contact made only in certain "vulnerable" areas, it is envisioned that these will be the most suitable locations for loop-type material 24. This also prevents the inadvertent transfer of an indicator from a participant to a non-scoring portion of the opponent's anatomy. Those portions of the anatomy which would include loop-type material 24 are envisioned to be the chest protector and the protective headgear.

It can be seen that where two participants are engaged in the sport, glove to glove contact will not result in the inadvertent transfer of an indicator if both participant's indicators are of the same type of material; i.e. hook-hook or loop-loop. The hook/loop engagement of even the inferior means will be sufficient to prevent the indicator from being dislodged from its position on the glove or protective boot.

It is also envisioned that the indicator when mounted in proper position on the participants protective equipment be colored a similar color so as to blend in with the participant's equipment. However, the opposite side of the indicator may be a color which contrasts dramatically with the coloration of the opponent's protective equipment so as to be readily apparent to any judge of the contest when contact has actually occurred. In order to increase the visibility and the indication of such a contact, a further embodiment of the present invention is illustrated in FIGS. 4A and 4B.

Figure 4A:
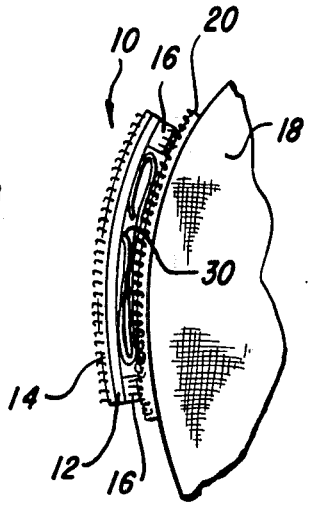
FIGS. 4A and 4B illustrate a further embodiment of the present invention first in position and secondly after contact has been made.
Figure 4B:
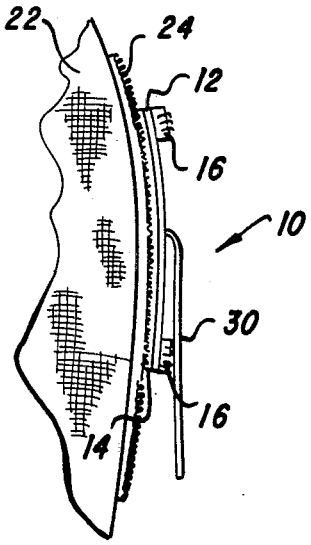

In FIG. 4A, a similar indicator 10 is illustrated in position on participant's equipment 18. However, attached to indicator 10 is a small colored streamer 30 which occupies the volume left by the removal of hook-type material in order to form ring 16.

When the indicator has been transferred to the opponent's equipment 22, the colored streamer 30 is no longer trapped out of sight between substrate 12 and participant's loop-type material 20 and, accordingly, falls free providing a much more visible indication of the existence and position of a "hit".

Obviously, if the anticipated rules change to point karate is made, the present invention with only a single indicator at each mounting location will provide only one scoring point regardless of how many repititions of a certain type punch are delivered. If the rules are not changed, it may be necessary to be able to mark the hit positions from multiple hits with the same punch. This could be accomplished within the scope of the present invention by stacking several indicators one on top of another on the participant's equipment. They would be sequentially transferred, instead of all at once, because the means generating a lesser retaining force of the exposed indicator would be less than the retaining force of a subsequent indicator and thus the first indicator would transfer at the first contact. The next indicator would transfer at the second contact, etc.

In accordance with the above disclosure, many applications and embodiments of the present invention will be obvious to those of ordinary skill in the art. For example, instead of a reduction in the amount of fastener material on the indicator (utilized in the illustrated embodiment to provide the inferior means), the amount of fastener material on the participant's equipment 18 could be reduced. In this manner, indicators could be identially constructed of back-to-back pieces of identical fastener material. In the event a colored streamer 30 was desired, there would still be room for it to be folded or coiled if the loop-type material 20 located on participant's equipment 18 were in the form of a ring.

Additionally, there is no requirment that the indicator be of a particular geometric shape or size and similarly there is no shape or size requirment with respect to the mounting locations on either the participant's equipment or the opponent's equipment. The only critical difference is that the retaining force generated by the inferior means be less than the retaining force generated by the superior means in order to ensure proper indicator transfer from participant's equipment to opponent's equipment when a blow is struck. It may be desirable to use different densities of hook and loop fastener to provide such difference in retaining forces. Furthermore, it is entirely possible that there are (or will be developed) adhesives which can be reused and will be useful for the indicator system. Therefore, the present system is not limited to hook- and loop-type fasteners and encompasses any such fastener system by which an indicator means may be transferred as discussed above.

Therefore, although the present specification is by way of example and description of preferred embodiments of the present invention, it is by no means limiting thereof of applicant's invention. The invention is limited only by the following claims appended hereto.

What I claim is:

1. A point indicating system for at least two individuals, a participant and an opponent, for indicating the existence and position of a blow struck by said participant on said opponent, said system comprising:

at least one indicator means;

inferior means, associated with said participant, for removably mounting said indicztor means on said participant; and superior means, associated with said opponent, for retainably mounting said indicator means, said superior means in combination with said indicator means comprising a means generating a greater retaining force and said inferior means in combination with said indicator means comprising a means generating a lesser retaining force, whereby said indicator means remains in contact with said inferior means until said blow is struck and contact is made between said indicator means and said superior means, whereupon said greater retaining force causes said indicator means to transfer to and remain in position on said superior means with respect to said opponent, wherein said indicator means comprises a planar indicator having two sides with one of hooks and loops from a hook and loop fastener system disposed on both sides of said planar indicator, said inferior means and said superior means comprising the other of said hooks and loops from said hook and loop fastener system.

2. The system according to claim 1, wherein said means generating a greater retaining force comprises a larger area of hook/loop interengagement than an area of hook/loop interengagement of said means generating a lesser retaining force.

3. The system according to claim 2, wherein said indicator side for mounting on said inferior mounting means has fewer of said one of hooks and loops than said indictor side for mounting on said superior mounting means has of said one of hooks and loops.

4. The system according to claim 1, wherein said indicator means includes a colored streamer hidden from view when said indicator means is mounted on said inferior means and exposed to view whenn said indicator means is transferred to said superior means.

* * * * *